US006616203B1

(12) United States Patent
Lenk et al.

(10) Patent No.: US 6,616,203 B1
(45) Date of Patent: Sep. 9, 2003

(54) DOOR LATCH OPERATOR MOUNT

(75) Inventors: Damon J. Lenk, Bristol, CT (US); Zakhary Fayngersh, West Hartford, CT (US)

(73) Assignee: Corbin Russwin, Inc.

( * ) Notice: Subject to any disclaimer, the term of this patent is extended or adjusted under 35 U.S.C. 154(b) by 0 days.

(21) Appl. No.: 10/227,741

(22) Filed: Aug. 26, 2002

(51) Int. Cl.[7] ..... E05B 3/00
(52) U.S. Cl. ..... 292/336.3; 292/357; 292/DIG. 53
(58) Field of Search ..... 292/336.3, 348, 292/349, 352, 355, DIG. 53, DIG. 64, 353

(56) References Cited

U.S. PATENT DOCUMENTS

| | | | | | |
|---|---|---|---|---|---|
| 133,842 | A | * | 12/1872 | Elwell | |
| 1,519,500 | A | * | 12/1924 | Miller | |
| 2,553,639 | A | * | 5/1951 | Dey | 292/357 |
| 3,211,487 | A | * | 10/1965 | Maursey | 292/353 |
| 4,037,865 | A | * | 7/1977 | Hook | 292/357 |
| 4,067,599 | A | | 1/1978 | Ohno | 292/356 |
| 4,569,547 | A | | 2/1986 | Fayerman et al. | 292/347 |
| 4,696,174 | A | | 9/1987 | Marks | 70/451 |
| 4,998,760 | A | | 3/1991 | Nixon et al. | 292/347 |
| 5,029,914 | A | * | 7/1991 | Hankel | 292/336.3 |
| 5,067,758 | A | | 11/1991 | Fann et al. | 292/347 |
| 5,077,994 | A | | 1/1992 | Trull et al. | 70/224 |
| 5,123,682 | A | | 6/1992 | Robida et al. | 292/169 |
| 5,322,333 | A | | 6/1994 | Norton, II et al. | 292/336.3 |
| 5,457,975 | A | | 10/1995 | Berger et al. | 70/370 |
| 5,566,996 | A | | 10/1996 | Massey et al. | 292/357 |
| 5,881,585 | A | | 3/1999 | Kang | 70/107 |
| 6,048,007 | A | | 4/2000 | Shor | 292/348 |
| 6,131,970 | A | | 10/2000 | Hurst et al. | 292/336.3 |
| 6,141,998 | A | | 11/2000 | Seo | 70/224 |
| 6,174,005 | B1 | | 1/2001 | Norton | 292/169.21 |
| 6,264,255 | B1 | | 7/2001 | Fortune | 292/336.3 |
| 6,279,360 | B1 | | 8/2001 | Shen | 70/224 |

* cited by examiner

*Primary Examiner*—Gary Estremsky
(74) *Attorney, Agent, or Firm*—Moore & Van Allen PLLC; Michael G. Johnston

(57) ABSTRACT

A door latch operator mount comprises a coupling member and a bearing member. The coupling member includes a plurality radial flanges and an integral resilient arcuate tab member projecting angularly outwardly of the outer surface of the coupling member. The coupling member is mounted to a door for receiving the bearing member. The bearing member has an opening for rotatably receiving a shaft of the latch operator. The bearing member also includes a plurality of flanges and an arcuate channel which tapers in depth. When the bearing member is positioned against the coupling member, the distance of the bearing member flanges from the surface of the coupling member is less than the distance of the coupling member flanges form the surface. The tab member is received in the deeper portion of the arcuate channel. Upon relative rotation, a shoulder on the tab member seats in a notch in the shallower portion of the channel and the bearing member flanges are positioned between the surface of the coupling member and the coupling member flanges. The tab member is urged inward creating a force biasing the bearing member outwardly away from the coupling member and forcing the respective flanges against one another. The bearing member is thus secured to the coupling member and the latch operator is mounted to the door for operative connection to a latch retraction mechanism. A tool is provided for releasably engaging the bearing member enabling rotation of the bearing member relative to the coupling member.

18 Claims, 5 Drawing Sheets

DOOR LATCH OPERATOR MOUNT

BACKGROUND

This invention relates generally to a door latch and, more particularly, to an apparatus for use with a door latch for operably mounting a latch operator on the door.

Door latches, including cylindrical passage sets, lock sets, mortise locks, and the like, generally comprise a housing disposed in an opening formed in the free, or unhinged, edge of a door. The housing accommodates the latch components including a latch bolt which projects from the housing beyond the edge of the door and into an opening in the door frame to latch the door in a closed position. The latch bolt is moveable by operation of a mechanism in the housing for retracting the latch bolt into the housing to permit opening of the door. A latch operator, such as a door knob or lever handle, is mounted to the door face and operably connected to the latch retraction mechanism through a transverse passage in the door for selective retraction of the latch bolt upon actuation of the latch operator.

Latch operators are typically mounted to the door and door latch by support structure including a rose assembly. The rose assembly is secured on the door or to the door latch and is configured to allow operative connection between the latch operator and latch retraction mechanism. Mounting the latch operator involves the steps of positioning the latch operator and associated rose assembly against the surface of the door and using fasteners to secure the latch operator to the housing in the door, or to the other rose assembly and latch operator on the opposite side of the door. The rose assembly is fixed against rotation while rotatably supporting operation of the latch operator.

Conventional latch operator installation involves the manipulation of several parts and takes considerable time. The installation apparatus can also require threaded components and other support structure to provide the necessary rotational stability to the assembly, all of which adds cost of manufacturing.

For the foregoing reasons, there is a need for a new means for mounting a latch operator to a door latch. The new latch operator mounting means should include fewer parts which result in a simpler and more efficient mounting procedure. Ideally, the new mounting means will also mount easily to doors regardless of the door thickness.

SUMMARY

According to the present invention, there is provided an apparatus for operably mounting a door latch operator for use with a door latch mounted within a door. The latch operator mounting apparatus comprises a coupling member adapted to be non-rotatably mounted relative to the door so that the inner surface of the coupling member is against the door. The coupling member includes a plurality flanges supported a first distance transversely outwardly of the outer surface of the coupling member and an integral resilient arcuate tab member projecting angularly outwardly of the outer surface of the coupling member. At the distal end of the tab member is a shoulder extending outwardly of the surface of the tab member. A bearing member has an opening for rotatably receiving a shaft portion of the latch operator for supporting the rotation of the latch operator about the shaft axis. The bearing member includes a plurality of flanges supported spaced from the inner surface of the bearing member so that when the inner surface of the bearing member is positioned against the outer surface of the mounting plate the distance of the bearing member flanges from the outer surface of the coupling member is less than the first distance. The bearing member also has an arcuate channel formed in the inner surface of the bearing member which gradually tapers in depth from a first deeper portion to a second shallower portion and has a notch in the shallower portion. In use, the inner surface of the bearing member is positioned against the outer surface of the coupling member in a first position where the respective flanges are angularly spaced and the tab member is received in the arcuate channel so that the distal end of the tab member is in the first deeper portion of the channel. When the so positioned bearing member and coupling member are rotated relative to one another in the direction of the decreasing depth of the channel to a second position, the shoulder seats in the notch in the second shallower portion of the channel and the bearing member flanges are positioned between the outer surface of the coupling member and the coupling member flanges. As the distal end of the tab member moves to the second shallower portion of the channel, the tab member is urged toward the outer surface of the coupling member creating a force biasing the bearing member outwardly away from the coupling member and forcing the respective flanges against one another whereby the bearing member is rotationally and axially secured relative to the coupling member and the latch operator is rigidly mounted to the door for operative connection to the latch retraction mechanism.

Also according to present invention, a door latch is provided comprising a housing adapted to be disposed in a door, a latch bolt in the housing movable between a projected position extending beyond the free edge of the door and a retracted position within the door, and means for moving the latch bolt from the projected position to the retracted position within the door upon actuation the latch bolt moving means. A coupling member is adapted to be non-rotatably mounted to the door so that an opening accommodates the interconnection between the latch bolt moving means and the latch operator. The coupling member includes a plurality of flanges supported a first distance transversely outwardly of the outer surface of the coupling member and an integral resilient arcuate tab member projecting angularly outwardly of the outer surface of the coupling member, the tab member having at a distal end thereof a shoulder extending outwardly of the surface of the tab member. A latch operator is provided, as is a bearing member having an opening for rotatably receiving a shaft portion of the latch operator for supporting the rotation of the latch operator about the shaft axis. The bearing member includes a plurality of radial flanges supported spaced from the inner surface of the bearing member so that when the inner surface of the bearing member is positioned against the outer surface of the mounting plate the distance of the bearing member flanges from the outer surface of the mounting plate is less than the first distance. An arcuate channel is formed in the inner surface of the bearing member which gradually tapers in depth from a first deeper portion to a second shallower portion and having a notch in the shallower portion. When the bearing member is positioned against the coupling member in a first position, the respective flanges are angularly spaced and the tab member is received in the arcuate channel so that the distal end of the tab member is in the first deeper portion of the channel. As the so positioned bearing member and coupling member are rotated relative to one another in the direction of the decreasing depth of the channel to a second position, the shoulder seats in the notch in the second shallower portion of the channel and the bearing member flanges are positioned between the outer surface of the coupling member and the coupling member flanges. Also, the distal end of the tab member is urged toward the outer surface of the coupling member creating a force biasing the bearing member outwardly away from the coupling member and forcing the respective flanges against one another whereby the bearing member is rotationally and axially secured relative to the coupling member and the latch operator is rigidly mounted to the door for operative connection of the shaft portion to the latch moving means for retraction of the latch bolt upon rotation of the latch operator about the shaft axis.

Further according to the present invention, a passageway is provided comprising a door having first and second major surfaces and a transverse opening formed adjacent the free edge of the door for accommodating a latch mechanism disposed in the door adjacent the free edge of the door. The latch mechanism includes means for moving the latch bolt from the projected position to the retracted position and is accessible through the transverse opening in the door. A coupling member is non-rotatably mounted to the door for securing the bearing member, as described above. The bearing member rotatably supports the latch operator for operative connection to the latch bolt moving means.

Still further according to the present invention, a kit is provided for mounting a door latch operator to a door. The kit comprises a coupling member and a bearing member, as described above, and a tool for releasably engaging the bearing member enabling rotation of the bearing member relative to the coupling member for securing the bearing member to the coupling member so that the latch operator carried by the bearing member is rigidly mounted to the door for operative connection to a latch retraction mechanism. In one embodiment, the tool comprises a handle portion and a gripping portion for receiving the bearing member and a detent extending radially inwardly for insertion into a radial opening in the periphery of the bearing member for non-rotatable engagement of the tool with the bearing member.

BRIEF DESCRIPTION OF DRAWINGS

For a more complete understanding of the present invention, reference should now be had to the embodiments shown in the accompanying drawings and described below. In the drawings.

DESCRIPTION

The door latch operator mount according to the present invention is for use with a door latch and may be used with any conventional door latch or door lock such as, for example, cylindrical passage sets, lock sets, mortise locks, and the like. It is understood that the construction of the latch or lock assembly is not critical to the present invention and, for purposes of illustration, may be the mortise lock described by U.S. Pat. No. 6,349,982, the contents of which are hereby incorporated by reference. Accordingly, detailed explanations of the functioning of all of the mortise lock components are deemed unnecessary for understanding of the present invention by one of ordinary skill in the art.

Certain terminology is used herein for convenience only and is not to be taken as a limitation on the invention. For example, words such as "upper," "lower," "left," "right," "horizontal," "vertical," "upward," and "downward" merely describe the configuration shown in the FIGS. Indeed, the components may be oriented in any direction and the terminology, therefore, should be understood as encompassing such variations unless specified otherwise.

Figure 1:
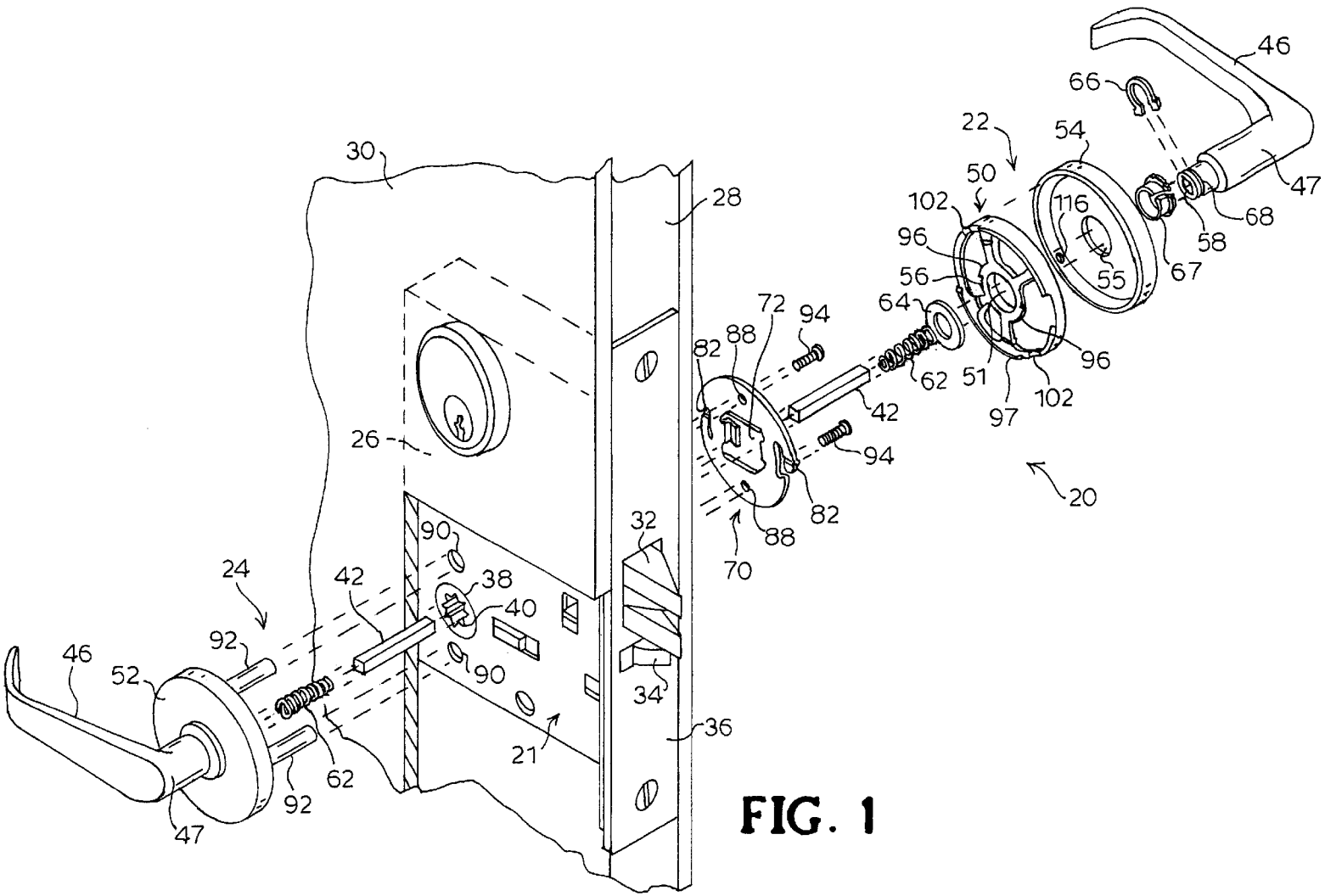
FIG. 1 is a perspective view of a portion of a free edge of a door with part of the door cut-away to show a mortise lock mounted in the door and exploded inner and outer lever handle assemblies according to the present invention.

Referring now to the drawings, wherein like reference numerals designate corresponding or similar elements throughout the several views, an exploded view of an embodiment of a door latch operator mount according to the present invention is shown in FIG. 1, generally designated at 20. The latch operator mount 20 is shown as part of a latch operator assembly 22 which, for the purpose of this description, will be designated an inside latch operator assembly 22 and the other latch operator assembly 24 will be designated an outside latch operator assembly. It is understood that the invention is not so limited.

As seen in FIG. 1, a conventional mortise lock 21 including a housing 26, shown in primarily in phantom, is mounted in a mortised recess formed in the free edge 28 of a door 30. The mortise lock housing 26 encloses the lock components, including a latch bolt 32 and an auxiliary bolt 34 projecting from openings in a face plate 36 secured to the mortise lock housing 26. It is understood that the auxiliary bolt 34 is not a necessary feature and may be omitted, and that other components, such as a deadbolt, may be added. The omission or addition of these components is easily accommodated in a conventional mortise lock by providing a housing 26 and face plate 36 with the corresponding openings.

The latch bolt 32 is moveable in the opening in the face plate 36 to a retracted position inside the housing 26 by operation of a retracting mechanism within the housing. In a mortise lock, the latch retracting mechanism generally includes a hub 38 rotatably mounted in opposed holes in the walls of the housing 26. The hub 38 has an irregular aperture 40 which is exposed through a transverse opening in the door 30 for receiving inside and outside spindle drives 42. The spindles 42 have a uniform rectangular cross-section for non-rotatable connection to the hub 38 and extend from the mechanism on each side of the door 30.

Latch operators, depicted as lever handles 46, are mounted on each spindle 42. Each of the lever handles 46 includes a shaft portion 47 having an irregular longitudinal bore 58 for non-rotational engagement with the outer ends of the spindles 42. A coil spring 62 fits in each of the bores 58 and is compressed between the end of the bore 58 and the spindle 42 for pressing outwardly on the spindle. The lever handles 46 are used for selective rotation of the spindles 42 and retraction of the latch bolt 32 when the lever handles 46 are rotated from a neutral, usually horizontal, position. Biasing means (not shown) restores the hub 38 and associated lever handles 46 to the neutral position and the latch bolt 32 to the extended position when the operative lever handle 46 is released. It is understood that different latch operators may be used, such as a knob, even on opposite sides of the same mortise lock 21. The mortise lock 21 can also be configured with independent coaxial hubs so that the lever handles 46 can operate independently. Alternatively, a unitary spindle (not shown) may pass through the door 30 and mortise lock housing 26 for connection to both lever handles 46 wherein rotation of one of the handles 46 would cause the other handle to rotate as well. Optionally, a locking function may be incorporated into the door lock, wherein a turn button or push button may be provided in the inside latch operator assembly 22 and a lock cylinder in the outside latch operator assembly 24.

Referring now to the right side of FIG. 1, the inside latch operator assembly 22 includes the aforementioned lever handle 46, a rose 50 and a rose scalp 54. The rose 50 and rose scalp 54 have axial circular openings 51, 55, for rotatably receiving the shaft portion 47 of the lever handle 46. The inside rose 50 is provided with an inwardly extending annular wall 56 defining the opening 51 in the rose 50 to provide bearing support for relative rotation of the shaft 47. In assembled condition (FIG. 6),an inner end portion of the shaft 47 is seated in a nylon bushing 67 in the rose 50 and projects inwardly from the opening 51 in the rose 50. A washer 64 fits over the end of the shaft 47 and is disposed against the rose 50. A spring clip 66 snaps into a circumferential groove 68 in the end of the shaft 47 to maintain the lever handle 46 on the rose 50. The rose scalp 54 fits tightly over the rose 50 for concealing and protecting the parts and for providing a decorative appearance. The axial location of the groove 68 is designed to provide close contact between the assembled components when the spring-clip 66 is within the groove 68. The close fit among the components allows freedom for rotational movement of the lever handle 46 about the longitudinal axis of the shaft portion 47 while allowing only minimal relative movement in the axial direction.

Figure 4:
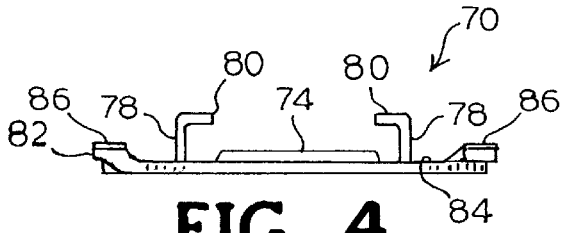
FIGS. 2–5 are front, rear and side views, respectively, of a mounting plate for a latch operator assembly according to the present invention.
Figure 2:
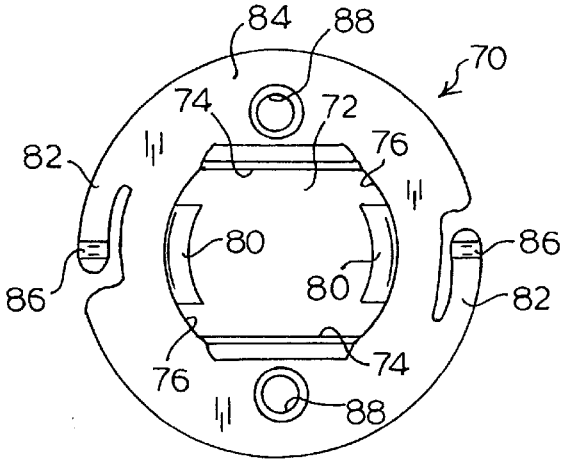
Figure 5:
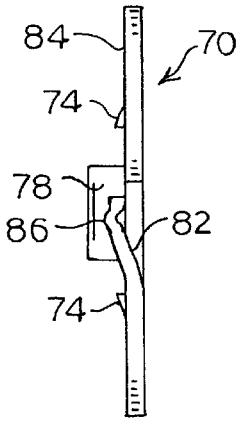
Figure 3:
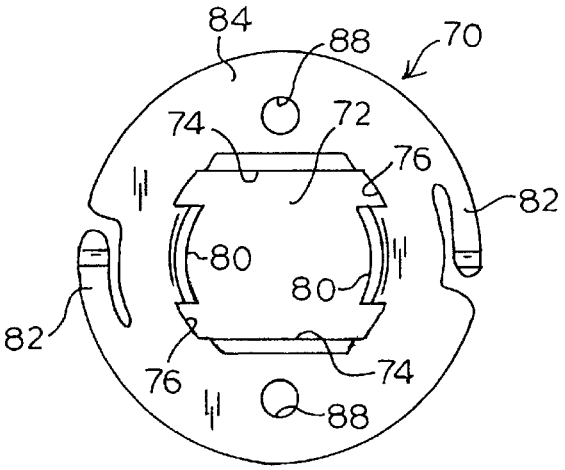

According to the present invention, a mounting plate 70 is provided for mounting the inside latch operator assembly 22 to the mortise lock 21 and door 30. The mounting plate 70 (FIGS. 2–5) is a flat, generally circular disc defining a central aperture 72 having opposed straight side walls 74 and opposed arcuate side walls 76. Arcuate bosses 78 extend outwardly from the arcuate sides 76 of the aperture 72. The outer ends of the bosses 78 terminate in inwardly turned flanges 80. Two opposed crescent-shaped tab members 82 are formed in the periphery of the mounting plate 70. The tab members 82 (FIGS. 4 and 5) are angled outwardly relative to the outer surface 84 of the mounting plate 70. The tab members 82 are resiliently deflectable. The free end of each tab member 82 is bent inwardly forming a shoulder 86. The mounting plate 70 may be produced as a metal die casting, a metal pressing or as a plastic molding.

Figure 6:
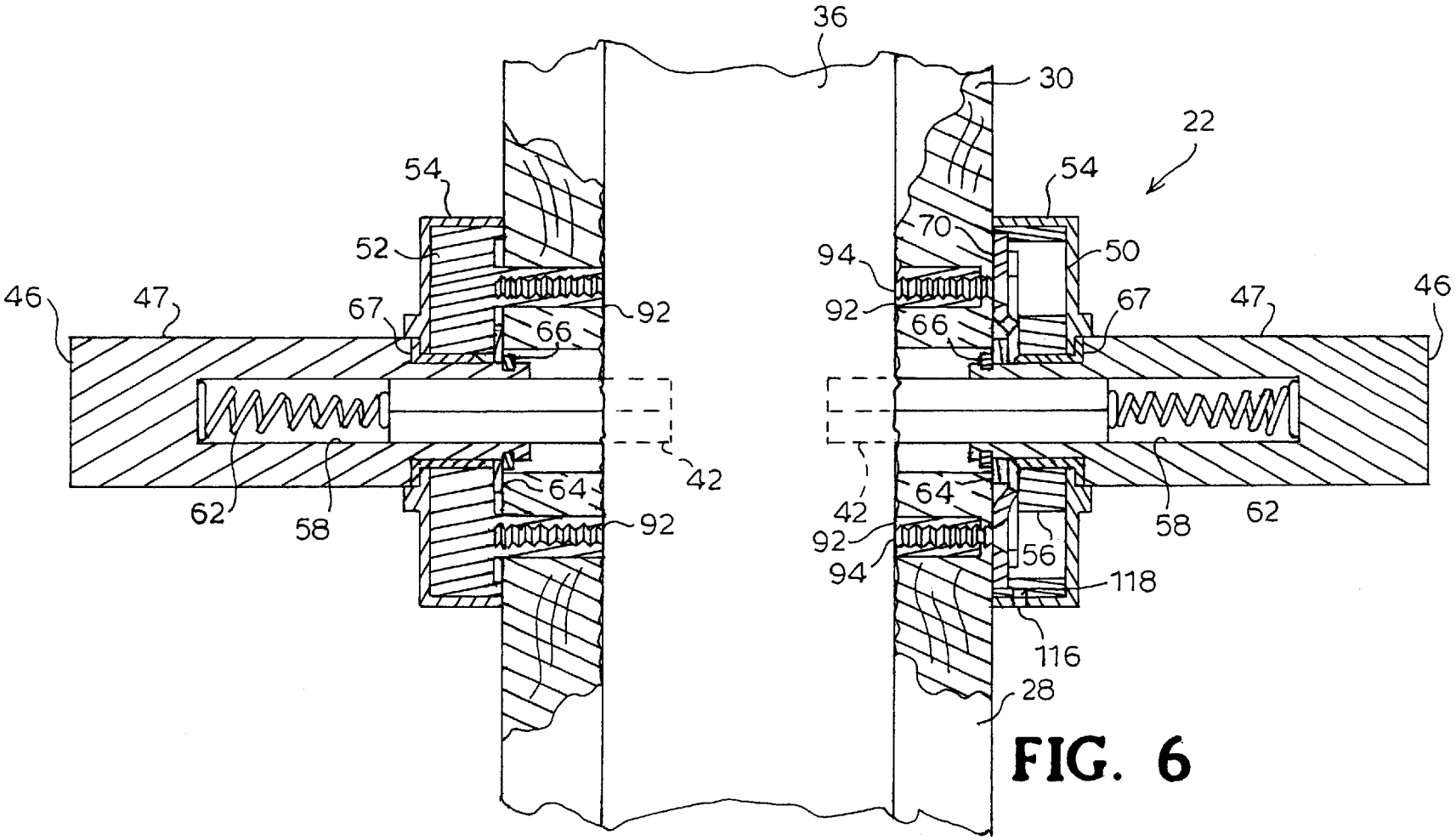
FIG. 6 is an elevated view of the free edge of the door shown in FIG. 1 with the lever handle assemblies mounted to the door and mortise lock and with the lever handle assemblies and a portion of the door edge shown in cross-section.

In use, the mounting plate 70 is held against the of the door 30 so that the central aperture 72 in the mounting plate 70 surrounds the transverse opening in the door 30 adjacent the hub 38 (FIG. 1). Opposed holes 88 in the mounting plate 70 are arranged to be aligned with smaller transverse holes 90 through the lock housing 26 and door 30. As seen in FIG. 1, a pair of internally-threaded posts 92 extend inwardly from the outside rose 52 of the outside latch operator assembly 24. Referring to FIG. 6, the posts 92 are positioned in the holes 90 in the lock housing 26 and door 30 to prevent the outside rose 52 from rotating relative to the door. The mounting plate 70 is fastened to the outside rose 52 and the lock housing 26 using a pair of screws 94 which are inserted through the holes 88 in the mounting plate 70 and threaded into the ends of the posts 92. The screws 94 draw the mounting plate 70 and outside rose 52 and latch operator assembly 24 securely together against the surfaces of the door 30. As will be described below, the mounting plate 70 is now in position for mounting of the inside latch operator assembly 22.

Figure 7:
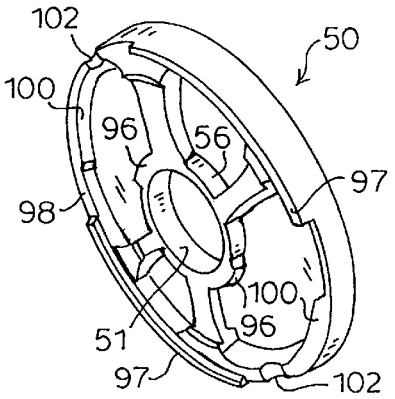
FIG. 7 is a perspective view of a rose for use in the door latch operator mount according to the present invention.

In keeping with the invention, the annular wall 56 on the inside rose 50 (FIG. 7) is provided with opposed partial flanges 96 which extend radially outwardly from the inner end of the wall 56. The inside rose 50 also includes an inwardly extending peripheral wall 98 having opposed ramps 100 formed therein. Each ramp 100 has a detent 102 formed in the upper, shallow portion of the ramp 100. Extending inwardly from the peripheral wall 98 are opposed arcuate rims 97. The distance between the rims 97 is slightly greater than the diameter of the mounting plate 70 so that the mounting plate is received in the recess defined by the rims 97 in the inner surface of the rose 50.

Figure 8:
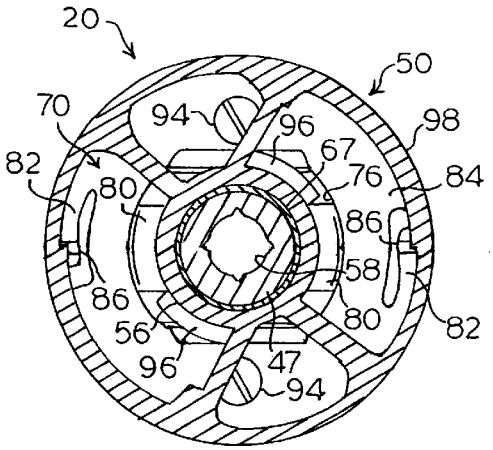
FIG. 8 is a cross-section of the inside lever handle assembly with the rose positioned against the mounting plate as shown in FIG. 13.
Figure 9:
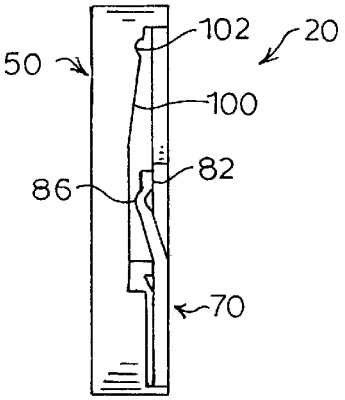
FIG. 9 is a side elevation view of the mounting plate and the rose in a first, unconnected position.

In use, the inside latch operator assembly 22 is centered over and against the mounting plate 70 and door 30 surface. The inner surface of the inside rose 50 is positioned (FIG. 8) relative to the outer surface 84 of the mounting plate 70 such that the bosses 78 and flanges 96 are in spaced, angular relation and the shoulders 86 on the free ends of the tab members 82 are in the deepest portion of the ramps 100 in the periphery of the inside rose 50 (FIG. 9).

Figure 10:
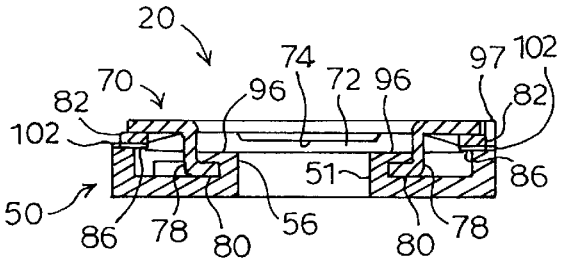
FIG. 10 is a cross-section of the rose connected with the mounting plate.
Figure 11:
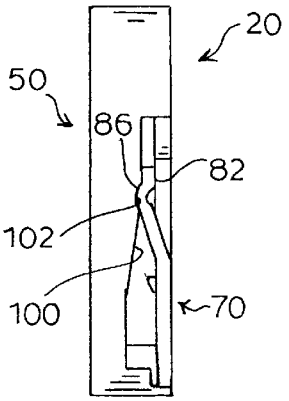
FIG. 11 is a side elevation view of the mounting plate and the rose, as shown in FIG. 9, with the rose connected with the mounting plate after the two components have been rotated relative to one another from the position shown in FIG. 9.

Next, the inside latch operator assembly 22 is rotated relative to the mounting plate 70 for securing the latch operator assembly 22 to the mounting plate 70. Relative rotation of the inside rose 50 and the mounting plate 70, preferably in a clockwise direction, moves the partial flanges 96 on the inside rose 50 under the respective bosses 78 on the mounting plate 70 (FIG. 10), and advances the tab members 82 "up" the ramps 100 until the shoulders 86 seat into the detents 102 formed in the shallow portions of the ramps 100 as best seen in FIG. 11. The flanges 96 and bosses 78 are configured on the mounting plate 70 and rose 50, respectively, so that the flanges 96 move under the bosses 78 when rotation begins thereby preventing relative axial movement of the rose 50 and mounting plate 70. As a result, the resilient tab members 82 are deflected inwardly toward the door 30 surface during rotation to conform to the ramps 100. This generates sufficient outward biasing force so that, when the shoulders 86 seat in the detents 102, the latch operator assembly 22 is rigidly fixed in position on the mounting plate 70 and door 30. Once assembled, the inside latch operator assembly 22 is secured both axially and rotationally in close connection with respect to the door 30 and the door lock 21.

Figure 12:
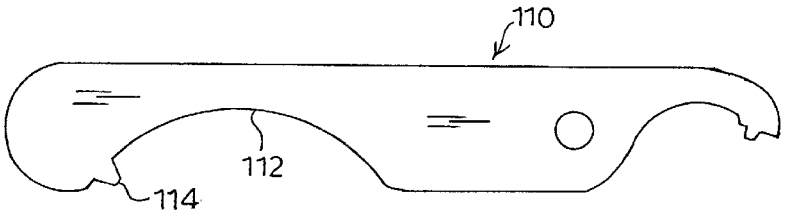
FIG. 12 is a plan view of a tool for mounting a latch operator assembly to a door according to the present invention.
Figure 13:
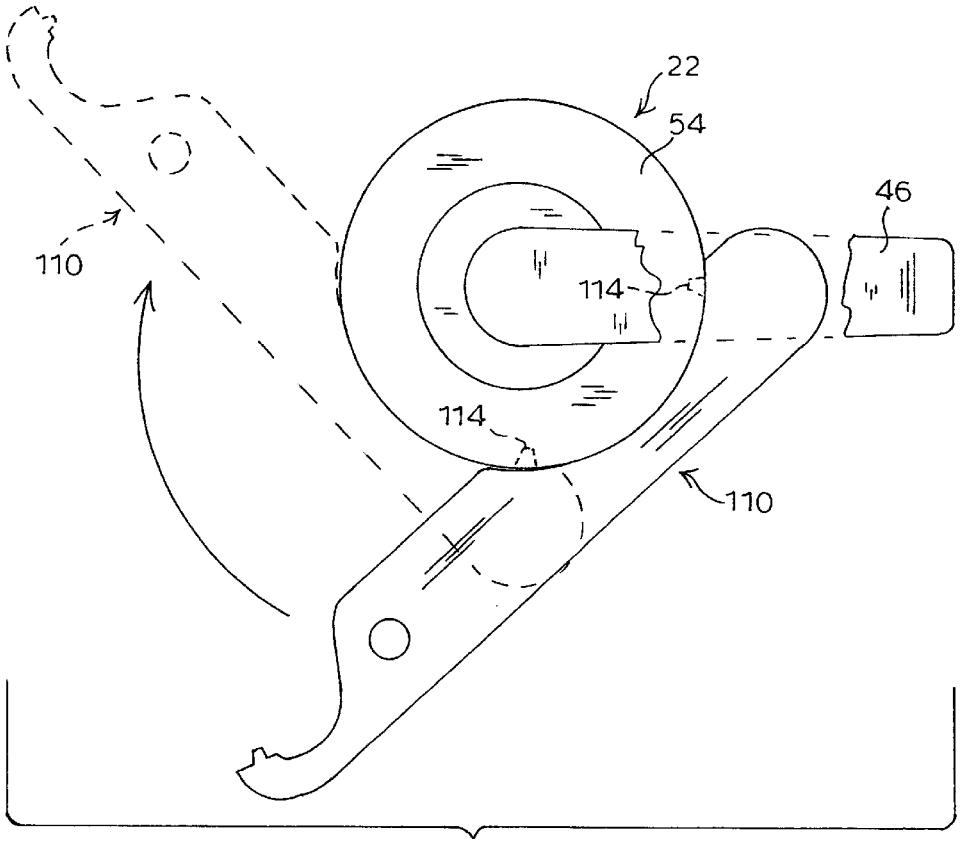
FIG. 13 is an elevation view showing the rotation of the rose and rose scalp of the latch operator assembly using the tool shown in FIG. 12 for mounting the latch operator to the door.

A special tool, shown in FIG. 12 and generally designated at 110, is preferably used to rotate the latch operator assembly 22, specifically the rose 50 and rose scalp 54, relative to the mounting plate 70 for securing the latch operator assembly 22 to the mounting plate 70 or for removing the latch operator assembly 22. The tool 110 includes an arcuate portion 112 at one end and a tooth 114 projecting radially inward from along the arcuate portion 112. A radial hole 116 (FIG. 1) is formed in the rim of the rose scalp 54 which aligns with a radial bore 116 in the inside rose 50. As seen in FIG. 13, the tool 110 is positioned against the latch operator assembly 22 with the tooth 114 in the hole 116 and bore 118 and the arcuate portion 112 of the tool 110 receiving the rose 50 and rose scalp 54. The tool 110 provides the leverage necessary for rotating the latch operator assembly 22 relative to the mounting plate 70. Approximately a one quarter turn is sufficient for securing the latch operator assembly 22 in place on the mounting plate 70. Preferably, this positions the hole 116 in the rose scalp 54 at the bottom of the latch operator assembly 22 so that the hole 116 is not visible when the latch operator assembly 22 is on the door 30. The operation is reversed for removing the latch operator assembly 22.

The present invention has many advantages, including providing a compact means for simply and easily installing a latch operator to a door latch. Conversely, the latch operator is easily removed for replacement because it is unnecessary to disassemble multiple components to permit installation of a new latch operator. The structure of the apparatus also has inherent strength to withstand the considerable torque generated by lever handles. The strength of the mounting system is important in resisting vandalism, damage to the lock and unauthorized entry. Further, the latch operator mount of the present invention can be used on doors with different thickness. Standard door preparation is all that is needed.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, the latch operator may be a door knob, and the invention may be employed with any type of door latch. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a crew may be equivalent structures.

We claim:

1. An apparatus for operably mounting a door latch operator to a door for use with a door latch mounted within the door, the door latch including a latch bolt and a latch bolt retraction mechanism accessible through a transverse opening in the door, the latch operator having a shaft portion for operative connection to the latch bolt retraction mechanism for moving the latch bolt from a projected position extending beyond a free edge of the door to a retracted position within the door upon actuation of the latch retraction mechanism by the latch operator, the latch operator mounting apparatus comprising:

a coupling member having an inner surface and an outer surface and an opening, the coupling member adapted to be non-rotatably mounted relative to the door so that the inner surface is against the door and the opening in the coupling member is in registry with the transverse opening in the door, the coupling member including a plurality of radial flanges supported a first distance transversely outwardly of the outer surface of the coupling member, and an integral resilient arcuate tab member projecting angularly outwardly of the outer surface of the coupling member, the tab member having at a distal end thereof a shoulder extending outwardly of the surface of the tab member; and a bearing member having an inner surface and an outer surface and an opening for rotatably receiving the shaft portion of the latch operator for supporting the rotation of the latch operator relative to the door about the shaft axis, the bearing member including a plurality of radial flanges supported spaced from the inner surface of the bearing member so that when the inner surface of the bearing member is positioned against the outer surface of the mounting plate the distance of the bearing member flanges from the outer surface of the mounting plate is less than the first distance, and an arcuate channel formed in the inner surface of the bearing member which tapers in depth from a first deeper portion to a second shallower portion and having a notch in the shallower portion, wherein, when the inner surface of the bearing member is positioned against the outer surface of the coupling member in a first position, the coupling member flanges are angularly spaced from the bearing member flanges and the tab member is received in the arcuate channel so that the distal end of the tab member is in the first deeper portion of the channel, and, when the so positioned coupling member and bearing member are rotated relative to one another in the direction of the decreasing depth of the channel to a second position where the shoulder on the tab member seats in the notch in the second shallower portion of the channel, the bearing member flanges are positioned between the outer surface of the coupling member and the coupling member flanges and the tab member is urged toward the outer surface of the coupling member creating a force biasing the bearing member outwardly away from the coupling member and forcing the bearing member flanges against the coupling member flanges whereby the bearing member is rotationally and axially secured relative to the coupling member and the latch operator is rigidly mounted to the door for operative connection to the latch retraction mechanism.

2. The door latch operator mounting apparatus as recited in claim 1, wherein the tab member is formed in the periphery of the coupling member.

3. The door latch operator mounting apparatus as recited in claim 1, further comprising a second tab member projecting angularly outwardly of the outer surface of the coupling member and oppositely disposed on the coupling member from the first tab member, and a second arcuate channel formed in the inner surface of the bearing member corresponding to the second tab member.

4. The door latch operator mounting apparatus as recited in claim 3, wherein the tab members are formed in the periphery of the coupling member.

5. The door latch operator mounting apparatus as recited in claim 1, wherein a circular boss extending transversely inwardly from the inner surface of the bearing member defines the opening in the bearing member and the bearing member flanges extend radially from the boss.

6. A door latch for use with a door having first and second major surfaces and a transverse opening formed adjacent the free edge of the door, the latch comprising:

a housing adapted to be disposed in the door for accommodating the latch components;

a latch bolt disposed in the housing for movement between a projected position extending beyond the free edge of the door and a retracted position within the door;

means for moving the latch bolt from the projected position to the retracted position upon actuation the latch bolt moving means;

a coupling member having an inner surface and an outer surface and an opening, the coupling member adapted to be non-rotatably mounted relative to the door so that the inner surface is against a major surface of the door and the opening in the coupling member is in registry with the transverse opening in the door, the coupling member including a plurality of radial flanges supported a first distance transversely outwardly of the outer surface of the coupling member, and an integral resilient arcuate tab member projecting angularly outwardly of the outer surface of the coupling member, the tab member having at a distal end thereof a shoulder extending outwardly of the surface of the tab member;

a latch operator having a shaft portion;

a bearing member having an inner surface and an outer surface and an opening for rotatably receiving the shaft portion of the latch operator for supporting the rotation of the latch operator about the shaft axis, the bearing member including a plurality of radial flanges supported spaced from the inner surface of the bearing member so that when the inner surface of the bearing member is positioned against the outer surface of the mounting plate the distance of the bearing member flanges from the outer surface of the mounting plate is less than the first distance, and an arcuate channel formed in the inner surface of the bearing member which gradually tapers in depth from a first deeper portion to a second shallower portion and having a notch in the shallower portion, wherein, when the inner surface of the bearing member is positioned against the outer surface of the coupling member in a first position, the coupling member flanges are angularly spaced from the bearing member flanges and the tab member is received in the arcuate channel so that the distal end of the tab member is in the first deeper portion of the channel, and, when the so positioned coupling member and bearing member are rotated relative to one another in the direction of the decreasing depth of the channel to a second position where the shoulder on the tab member seats in the notch in the second shallower portion of the channel, the bearing member flanges are positioned between the outer surface of the coupling member and the coupling member flanges and the tab member is urged toward the outer surface of the coupling member creating a force biasing the bearing member outwardly away from the coupling member and forcing the bearing member flanges against the coupling member flanges whereby the bearing member is rotationally and axially secured relative to the coupling member and the latch operator is rigidly mounted to the door to the door and operably connected to the latch bolt moving means for retraction of the latch bolt upon rotation of the latch operator about the shaft axis.

7. A door latch as recited in claim 6, wherein the end of the shaft portion extending beyond the inner surface of the bearing member has a circumferential groove for receiving a clip having a wider diameter than the shaft portion for axially securing the shaft portion relative to the bearing member.

8. A door latch as recited in claim 6, wherein the coupling member is fastened to the housing.

9. A door latch as recited in claim 6, wherein the latch operator is a lever handle.

10. A door latch as recited in claim 6, wherein the latch operator is a knob.

11. A door latch as recited in claim 6, further comprising a second latch operator adapted to be rotatably positioned on the other major surface of the door, and wherein the coupling member is secured to the second latch operator through the housing.

12. A passageway comprising:

a door having first and second major surfaces and a transverse opening formed adjacent the free edge of the door, a latch mechanism disposed in the door adjacent the free edge of the door, the latch mechanism including a housing for accommodating the components of the latch mechanism, a latch bolt disposed in the housing for movement between a projected position extending beyond the free edge of the door and a retracted position within the door, and means for moving the latch bolt from the projected position to the retracted position upon actuation of the latch bolt moving means, the latch bolt moving means being disposed in the housing and accessible through the transverse opening in the door;

a coupling member having an inner surface and an outer surface and an opening, the coupling member adapted to be non-rotatably mounted relative to the door so that the inner surface is against a major surface of the door and the opening in the coupling member is in registry with the transverse opening in the door, the coupling member including a plurality of radial flanges supported a first distance transversely outwardly of the outer surface of the coupling member, and an integral resilient arcuate tab member projecting angularly outwardly of the outer surface of the coupling member, the tab member having at a distal end thereof a shoulder extending outwardly of the surface of the tab member;

a latch operator having a shaft portion;

a bearing member having an inner surface and an outer surface and an opening for rotatably receiving the shaft portion of the latch operator for supporting the rotation of the latch operator relative to the door about the shaft axis, the bearing member including a plurality of radial flanges supported spaced from the inner surface of the bearing member so that when the inner surface of the bearing member is positioned against the outer surface of the mounting plate the distance of the bearing member flanges from the outer surface of the mounting plate is less than the first distance, and an arcuate channel formed in the inner surface of the bearing member which gradually tapers in depth from a first deeper portion to a second shallower portion and having a notch in the shallower portion, wherein, when the inner surface of the bearing member is positioned against the outer surface of the coupling member in a first position, the coupling member flanges are angularly spaced from the bearing member flanges and the tab member is received in the arcuate channel so that the distal end of the tab member is in the first deeper portion of the channel, and, when the so positioned coupling member and bearing member are rotated relative to one another in the direction of the decreasing depth of the channel to a second position where the shoulder on the tab member seats in the notch in the second shallower portion of the channel, the bearing member flanges are positioned between the outer surface of the coupling member and the coupling member flanges and the tab member is urged toward the outer surface of the coupling member creating a force biasing the bearing member outwardly away from the coupling member and forcing the bearing member flanges against the coupling member flanges whereby the bearing member is rotationally and axially secured relative to the coupling member and the latch operator is rigidly mounted to the door and operably connected to the latch bolt moving means for retraction of the latch bolt upon rotation of the latch operator about the shaft axis.

13. A passageway as recited in claim 12, wherein the latch operator is a lever handle.

14. A passageway as recited in claim 12, wherein the latch operator is a knob.

15. A door latch as recited in claim 12, wherein the coupling member is fastened to the door.

16. A kit for mounting a door latch operator to a door for use with a door latch mounted within the door, the door latch including a latch bolt and a latch bolt retraction mechanism accessible through a transverse opening in the door, the latch operator having a shaft portion for operative connection to the latch bolt retraction mechanism for moving the latch bolt from a projected position extending beyond a free edge of the door to a retracted position within the door upon actuation of the latch retraction mechanism by the latch operator, the door latch operator mounting kit comprising:

a coupling member having an inner surface and an outer surface and an opening, the coupling member adapted to be non-rotatably mounted relative to the door so that the inner surface is against the door and the opening in the coupling member is in registry with the transverse opening in the door, the coupling member including a plurality of radial flanges supported a first distance transversely outwardly of the outer surface of the coupling member, and an integral resilient arcuate tab member projecting angularly outwardly of the outer surface of the coupling member, the tab member having at a distal end thereof a shoulder extending outwardly of the surface of the tab member;

a bearing member having an inner surface and an outer surface and an opening for rotatably receiving the shaft portion of the latch operator for supporting the rotation of the latch operator relative to the door about the shaft axis, the bearing member including a plurality of radial flanges supported spaced from the inner surface of the bearing member so that when the inner surface of the bearing member is positioned against the outer surface of the mounting plate the distance of the bearing member flanges from the outer surface of the mounting plate is less than the first distance, and an arcuate channel formed in the inner surface of the bearing member which tapers in depth from a first deeper portion to a second shallower portion and having a notch in the shallower portion; and a tool for releasably engaging the bearing member and, when engaged with the bearing member, enabling rotation of the bearing member relative to the coupling member so that, when the inner surface of the bearing member is positioned against the outer surface of the coupling member in a first position, the coupling member flanges are angularly spaced from the bearing member flanges and the tab member is received in the arcuate channel so that the distal end of the tab member is in the first deeper portion of the channel, and, when the so positioned coupling member and bearing member are rotated relative to one another by the tool in the direction of the decreasing depth of the channel to a second position where the shoulder on the tab member seats in the notch in the second shallower portion of the channel, the bearing member flanges are positioned between the outer surface of the coupling member and the coupling member flanges and the tab member is urged toward the outer surface of the coupling member creating a force biasing the bearing member outwardly away from the coupling member and forcing the bearing member flanges against the coupling member flanges whereby the bearing member is rotationally and axially secured relative to the coupling member and the latch operator is rigidly mounted to the door for operative connection to the latch retraction mechanism.

17. A door latch operator mounting kit as recited in claim 16, wherein the bearing member is circular in cross-section and has a radial opening formed in the periphery, and the tool comprises a handle portion; and a gripping portion having at least a partial arcuate shape for receiving the bearing member and a detent extending radially inwardly for insertion into the radial opening in the periphery of the bearing member for non-rotatable engagement of the tool with the bearing member.

18. A door latch operator mounting kit as recited in claim 16, further comprising a rose scalp which fits over the outer surface of the bearing member, the rose scalp having an opening in the periphery for alignment with the opening in the periphery of the bearing member.

* * * * *